US007199094B2

(12) United States Patent
Cheung et al.

(10) Patent No.: US 7,199,094 B2
(45) Date of Patent: Apr. 3, 2007

(54) HARD SURFACE CLEANING COMPOSITIONS COMPRISING A MIXTURE OF CITRIC AND FORMIC ACID

(75) Inventors: Tak Wai Cheung, Bridgewater, NJ (US); Benjamin Costa, Nutley, NJ (US); Edward Fu, Kinnelon, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 0 days.

(21) Appl. No.: 10/505,068

(22) PCT Filed: Feb. 20, 2003

(86) PCT No.: PCT/GB03/00743

§ 371 (c)(1),
(2), (4) Date: Sep. 8, 2004

(87) PCT Pub. No.: WO03/070872

PCT Pub. Date: Aug. 28, 2003

(65) Prior Publication Data

US 2005/0130873 A1 Jun. 16, 2005

(30) Foreign Application Priority Data

Feb. 21, 2002 (GB) ..... 0204039.2

(51) Int. Cl.
*C11D 7/26* (2006.01)
*C11D 3/37* (2006.01)
*C11D 1/02* (2006.01)

(52) U.S. Cl. ..... 510/363; 510/238; 510/245; 510/247; 510/253; 510/256; 510/268; 510/395; 510/398; 510/475; 510/485; 510/486; 510/507; 510/511; 510/477; 510/426

(58) Field of Classification Search ..... 510/363, 510/238, 245, 247, 253, 256, 268, 395, 398, 510/475, 485, 486, 507, 511, 477
See application file for complete search history.

(56) References Cited

U.S. PATENT DOCUMENTS

| | | | | | |
|---|---|---|---|---|---|
| 3,579,456 | A | | 5/1971 | Cambre | 252/137 |
| 4,532,066 | A | | 7/1985 | Paszek et al. | 252/144 |
| 4,581,042 | A | | 4/1986 | Willmore | 51/293 |
| 4,759,867 | A | | 7/1988 | Choy et al. | 252/143 |
| 5,008,030 | A | | 4/1991 | Cook et al. | 252/106 |
| 5,039,441 | A | | 8/1991 | Thomas et al. | 252/142 |
| 5,061,393 | A | | 10/1991 | Linares et al. | 252/143 |
| 5,076,955 | A | * | 12/1991 | Ussat et al. | 510/238 |
| 5,192,460 | A | | 3/1993 | Thomas et al. | 252/142 |
| D383,678 | S | | 9/1997 | Syrek | D9/526 |
| 5,872,088 | A | * | 2/1999 | Pucci et al. | 510/238 |
| D406,530 | S | | 3/1999 | Bodker et al. | D9/526 |
| D406,531 | S | | 3/1999 | Bodker et al. | D9/526 |
| D410,847 | S | | 6/1999 | Bodker et al. | D9/526 |
| 6,159,925 | A | * | 12/2000 | Blandiaux | 510/437 |
| 6,251,849 | B1 | * | 6/2001 | Jeschke et al. | 510/470 |

FOREIGN PATENT DOCUMENTS

| | | | |
|---|---|---|---|
| GB | 945 044 | A | 12/1963 |
| GB | 2 306 499 | A | 5/1997 |
| WO | 0109279 | * | 2/2001 |
| WO | WO 01 09279 | A | 2/2001 |
| WO | WO 01/57174 | A1 | 8/2001 |

OTHER PUBLICATIONS

Combined Search and Examination Report from The Patent Office in the United Kingdom for Application No. GB 0204039.2 dated Oct. 28, 2002.

* cited by examiner

*Primary Examiner*—Charles Boyer
(74) *Attorney, Agent, or Firm*—Norris McLaughlin & Marcus PA

(57) ABSTRACT

Improved hard surface cleaning compositions having an acidic pH provide good removal of soap scum stains. Compositions of the present invention comprise an acidic constituent which comprises either citric acid alone or citric acid in combination with an acid selected from the group consisting of sorbic acid, acetic acid, boric acid, formic acid, maleic acid, adipic acid, lactic acid, malic acid, malonic acid, glycolic acid, and mixtures thereof; at least one anionic surfactant; at least one thickener; at least one scrubbing agent; one or more optional constituents; and the balance water; wherein the aqueous hard surface cleaning composition exhibits a pH of 6.0 or less.

20 Claims, No Drawings

HARD SURFACE CLEANING COMPOSITIONS COMPRISING A MIXTURE OF CITRIC AND FORMIC ACID

The present invention relates to improved cleaning compositions which find particular use in hard surface cleaning applications, particularly lime, rust, and soap scum stains.

Cleaning compositions are commercially important products and enjoy a wide field of utility in assisting in the removal of dirt and grime from surfaces, especially those characterized as useful with "hard surfaces". Hard surfaces are those which are frequently encountered in lavatories such as lavatory fixtures such as toilets, shower stalls, bathtubs, bidets, sinks, etc., as well as countertops, walls, floors, etc. In such lavatory environment various forms of undesirable residues are known to form including hard water stains as well as "soap scum stains". Hard water stains are mineral stains caused by the deposition of salts, such as calcium or magnesium salts, frequently present in hard water, soap scum stains are residues of fatty acid soaps such as soaps which are based on alkaline salt of low fatty acids, which fatty acids are known to precipitate in hard water due to the presence of metal salts therein leaving an undesirable residue upon such surfaces.

Various formulations in compositions of cleaning agents have been produced and are known to the art which cleaning agents are generally suited for one type of stain but not necessarily for both classes of stains. For example, it is known to the art that highly acidic cleaning agents comprising strong acids, such as hydrochloric acids, are useful in the removal of hard water stains. However, the presence of strong acids is known to be an irritant to the skin and further offers the potential of toxicological danger. Other classes of cleaning compositions and formulations are knowri to be useful upon soap scum stains, however, generally such compositions comprise an organic and/or inorganic acid, one or more synthetic detergents from commonly recognized classes such as those described in U.S. Pat. Nos. 5,061,393; 5,008,030; 4,759,867; 5,192,460; 5,039,441. Generally, the compositions described in these patents are claimed to be effective in the removal of soap scum stains from such hard surfaces and may find further limited use in other classes of stains.

However, the formulations of most of the compositions within the aforementioned patents generally have relatively high amounts of acids (organic and/or inorganic) which raises toxicological concerns, and further none of the above patents provide any disinfecting properties.

Thus, it is among the objects of the invention to provide improved cleaning compositions which provide the benefits of low toxicity, and hard water stain removal and soap scum stain removal and are effective in providing a disinfecting effect and facilitate in the removal of soap scum stains and hard water stains, especially from hard surfaces. It is a further object of the invention to provide improved cleaning compositions which are particularly effective in hard water stain removal and soap scum stain removal, and which further features minimal irritability to the eyes, skin or mucous tissues of a consumer.

It is yet a further object of the invention to provide a readily pourable cleaning composition which features the benefits described above.

It is a further object of the invention to provide a process for the improvement of the simultaneous cleaning and sanitization of hard surfaces, which process comprises the step of: providing a cleaning composition as outlined above, and applying an effective amount to a hard surface requiring such treatment.

These and other objects of the invention shall be more apparent from a reading of the specification and of the claims attached.

According to the invention, there is provided an aqueous hard surface cleaning composition which comprises an acidic constituent which comprises either citric acid alone or citric acid in combination with an acid selected from the group consisting of sorbic acid, acetic acid, boric acid, formic acid, maleic acid, adipic acid, lactic acid, malic acid, malonic acid, glycolic acid, and mixtures thereof; 0.001–10% by weight of at least one anionic surfactant; 0.001–10% by weight of thickener selected from the group consisting of cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, succinoglycan, xanthan gum, guar gum, locust bean gum, tragacanth gum or derivatives thereof, clays selected from kaolinite, dicktite, hectorite, bentonite, nacrite, halloysite, endillite, chrysotile, amesite, beidellite, nontronite, saponite, sauconite, illites; glauconite, chlorite, vermiculite, attapulgite, sepiolite, allophane, and imogolite, and silicas selected from diatomite, precipitated silica and fumed silica, and mixtures thereof; 10–30% by weight of a scrubbing agent selected from quartzes, siliceous chalk, diatomaceous earth, colloidal silicon dioxide, alkali metasilicates, organic abrasive materials selected from polyolefins, polyethylenes, polypropylenes, polyesters, polystyrenes, acetonitrile-butadiene-styrene resins, melamines, polycarbonates, phenolic resins, epoxies and polyurethanes and mixtures thereof; 0–10% by weight of one or more optional constituents; and the balance to 100% by weight, water; wherein the aqueous hard surface cleaning composition exhibits a pH of 6.0 or less.

Preferably, the acid constituent is a combination of citric acid in combination with an acid selected from the group consisting of sorbic acid, acetic acid, boric acid, formic acid, maleic acid, adipic acid, lactic acid, malic acid, malonic acid, and glycolic acid. More preferably, the acid constituent is a combination of citric acid with formic acid.

The amount of acid present in the composition, keeping in mind any optional ingredients that may be present, should be in an amount such that the pH of the composition is less than 6, preferably from about 5.0 to about 1.0, more preferably from about 4.0 to about 1.0, and even more preferably from about 3.0 to about 1.0.

Preferably, the thickener is a combination of a clay and xanthan gum, more preferably a combination of bentonite clay and xanthan gum.

The present invention also provides for an aqueous hard surface cleaning composition which comprises an acidic constituent which comprises citric acid in combination with an acid selected from the group consisting of sorbic acid, acetic acid, boric acid, formic acid, maleic acid, adipic acid, lactic acid, malic acid, malonic acid, glycolic acid, and mixtures thereof; 0.001–10% by weight of at least one anionic surfactant; 0.001–10 % by weight of thickener selected from the group consisting of cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, succinoglycan, xanthan gum, guar gum, locust bean gum, tragacanth gum or derivatives thereof, clays selected from kaolinite, dicktite, hectorite, bentonite, nacrite, halloysite, endillite, chrysotile, amesite, beidellite, nontronite, saponite, sauconite, illites; glauconite, chlorite, vermiculite, attapulgite, sepiolite, allophane, and imogolite, and silicas selected from diatomite, precipitated silica and fumed silica, and mixtures thereof; 10–30% by weight of a scrubbing agent selected from quartzes, siliceous chalk, diatomaceous earth, colloidal silicon dioxide, alkali metasilicates, organic abrasive materials selected from polyolefins, polyethylenes, polypropylenes, polyesters, polystyrenes, acetonitrile-butadiene-styrene resins, melamines, polycarbonates, phenolic resins, epoxies and polyurethanes and mixtures thereof; 0–10% by weight of one or more optional constituents; and the balance to 100% by weight, water; wherein the aqueous hard surface cleaning composition exhibits a pH of 6.0 or less.

Preferably, the thickener is a combination of a clay and xanthan gum, more preferably a combination of bentonite clay and xanthan gum.

The compositions of the invention may also include one or more further optional constituents such as known art additives. By way of non-limiting example, such constituents include: nonionic surfactants, coloring agents, including dyes and pigment compositions, fragrances, fragrance adjuvants and/or fragrance solubilizers, pH adjusting agents, pH buffers, antioxidants, water softening agents, and preservative compositions.

The compositions according to the invention are preferably acidic in character, exhibiting a pH of less than 6.0, desirably the pH is in the range of from about 5.0 to about 1.0 and yet more desirably is a pH in the range of about 4.0 to about 1.0 and most desirably is a pH in from 3.0–1.0.

The present invention also provides for an aqueous hard surface cleaning composition which comprises an acidic constituent which comprises citric acid in combination with formic acid; 0.001–10% by weight of at least one anionic surfactant; 0.001–10% by weight of thickener selected from the group consisting of cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, succinoglycan, xanthan gum, guar gum, locust bean gum, tragacanth gum or derivatives thereof, clays selected from kaolinite, dicktite, hectorite, bentonite, nacrite, halloysite and endillite, chrysotile and amesite, beidellite, nontronite, saponite, sauconite, illites; glauconite, chlorite, vermiculite, attapulgite, sepiolite, allophane, and imogolite, and silicas selected from diatomite, precipitated silica and fumed silica, and mixtures thereof; 10–30% by weight of a scrubbing agent selected from quartzes, siliceous chalk, diatomaceous earth, colloidal silicon dioxide, alkali metasilicates, organic abrasive materials selected from polyolefins, polyethylenes, polypropylenes, polyesters, polystyrenes, acetonitrile-butadiene-styrene resins, melamines, polycarbonates, phenolic resins, epoxies and polyurethanes and mixtures thereof; 0–10% by weight of one or more optional constituents; and the balance to 100% by weight, water; wherein the aqueous hard surface cleaning composition exhibits a pH of 6.0 or less.

The amount of acid present in the composition, keeping in mind any optional ingredients that may be present, should be in an amount such that the pH of the composition is less than 6, preferably from about 5.0 to about 1.0, more preferably from about 4.0 to about 1.0, and even more preferably from about 3.0 to about 1.0.

Preferably, the thickener is a combination of a clay and xanthan gum, more preferably a combination of bentonite clay and xanthan gum.

In a further aspect of the invention, there is also provided improved process for cleaning surfaces especially hard surfaces which includes the step of applying to the surface an effective amount of a stain releasing composition as taught herein to such surface.

The acidic constituent of the present invention comprises either citric acid alone or citric acid in combination with an acid selected from the group consisting of sorbic acid, acetic acid, boric acid, formic acid, maleic acid, adipic acid, lactic acid, malic acid, malonic acid, glycolic acid and mixtures thereof. Preferably, the acid constituent is citric acid in combination with an acid selected from the group consisting of sorbic acid, acetic acid, boric acid, formic acid, maleic acid, adipic acid, lactic acid, malic acid, malonic acid, glycolic acid, and mixtures thereof. More preferably, the acid constituent is citric acid in combination with formic acid.

These acids provide free acidity within the cleaning composition which free acid reacts with the fatty acid metal salts which are comprised within soap scum stains releasing the metal ions and freeing the fatty acid, which facilitates the removal of these undesired stains from hard surfaces. These acids also sequester the resulting free metal ions which are released from the soap scum stains. Also where the acids are selected to feature disinfecting properties, they concomitantly provide anti-microbial activity necessary to disinfect the cleaned surface.

The acid constituent is desirably present in the formulations such that with the presence of optional ingredients taken into account, the pH of the formulation is at a pH of less than 6, more preferably, the pH is in the range of from about 5.0 to about 1.0 and most desirably is a pH in from 3.0–1.0. The pH range represents an amount of acid from about 0.5 to about 10% by weight based on the total weight of a composition.

Compositions of the present invention also include at least anionic surfactant. Suitable anionic surfactants include, for example, alcohol sulfates (e.g. alkali metal or ammonium salts of alcohol sulfates) and sulfonates, alcohol phosphates and phosphonates, alkyl sulfates, alkyl ether sulfates, sulfate esters of an alkylphenoxy polyoxyethylene ethanol, alkyl monoglyceride sulfates, alkyl sulfonates, alpha-olefin sulfonates, beta-alkoxy alkane sulfonates, alkyl ether sulfonates, ethoxylated alkyl sulfonates, alkylaryl sulfonates, alkyl benzene sulfonates, alkyl monoglyceride sulfonates, alkyl carboxylates, alkyl ether carboxylates, alkyl alkoxy carboxylates having 1 to 5 moles of ethylene oxide, sulfosuccinates, octoxynol or nonoxynol phosphates, taurates, fatty taurides, fatty acid amide polyoxyethylene sulfates, isethionates, and sarcosinates or mixtures thereof. Preferred anionics include alkyl sulfates. The anionic surfactant is present in the compositions of the present invention in an amount of from about 0.1 to about 10% by weight, more preferably from about 0.5 to about 4% by weight.

The composition of the present of invention is thickened to a viscosity range of from about 100 to about 2000 centipoise, preferably to a viscosity of from about 750 to about 1000 centipoise, more preferably about 900 centipoise, at room temperature, measured by a Brookfield RVT viscometer, spindle #2, at 60 rpm. Thickeners useful in the present invention to achieve this viscosity are selected from the group consisting of a thickener selected from the group consisting of cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, succinoglycan, xanthan gum, guar gum, locust bean gum, tragacanth gum or derivatives thereof, clays selected from kaolinite, dicktite, hectorite, bentonite, nacrite, halloysite and endillite, chrysotile and amesite, beidellite, nontronite, saponite, sauconite, illites; glauconite, chlorite, vermiculite, attapulgite, sepiolite, allophane, and imogolite, and silicas selected from diatomite, precipitated silica and fumed silica, and mixtures thereof. Preferably, the thickener is a mixture of clay and xanthan gum, more preferably when the clay is bentonite.

The amount of thickener present in the composition ranges from about 0.001 to about 10% by weight.

The present invention also includes a scrubbing, or abrasive, agent. Suitable scrubbing agents are selected from quartzes, siliceous chalk, diatomaceous earth, colloidal silicon dioxide, alkali metasilicates, organic abrasive materials selected from polyolefins, polyethylenes, polypropylenes, polyesters, polystyrenes, acetonitrile-butadiene-styrene resins, melamines, polycarbonates, phenolic resins, epoxies and polyurethanes and mixtures thereof. The amount of scrubbing agent present is from about 10 to about 30 percent by weight. Generally, the scrubbing agent should be present in a particle size within the range from about 40 to about 400 mesh. The preferred mesh size is 140 to 200 mesh. When the particles are in the 100 to 400 mesh and preferably 140 to 200 mesh size range they can be readily suspended into a homogeneous stable liquid dispersion, yet they are large enough to provide adequate scouring properties.

As is noted above, the compositions according to the invention are aqueous in nature.

Water is added to the above constituents in order to provide 100% by weight of the composition.

The water may be tap water, but is preferably distilled and is most preferably deionized water. If the water is tap water, it is preferably substantially free of any undesirable impurities such as organics or inorganics, especially minerals salts which are present in hard water which may thus interfere with the operation of Constituents A, B, C, as well as any other optional components of the aqueous The compositions according to the invention may comprise one or more of the following optional components, the total weight of such optional constituents not exceeding about 10% by weight of the total weight of the composition, more preferably not exceeding about 5% by weight and is most preferably less than 5% by weight based on the total weight of the composition according to the invention.

Non-ionic surfactants of the conventionally known and used variety in this class of cleaning agents may be added in effective amounts, i.e., amounts which are shown to be effective in the cleaning compositions in facilitating the removal of greasy soils. Such greasy soils are to be differentiated from the hard water stains and the soap scum stains described earlier in this specification. However, it is also to be appreciated that the non-ionic surfactants of this optional constituent may be also at least partially effective in the solubilization and removal of soap scum stains. Exemplary nonionic surfactants include known nonionic surfactants which generally consist of a hydrophobic moiety, such as C6-C20 primary or secondary, branched or straight chain monoalcohols, C8-C18 mono-or dialkyphenols, C6-C20 fatty acid amides, and a hydrophilic moiety which consists of alkylene oxide units. These nonionic surfactants are for instance alkoxylation products of the above hydrophobic moieties, containing from 2 to 30 moles of alkylene oxide. As alkylene oxides ethylene-, propylene- and butylene oxides and mixtures thereof are used.

Typical examples of such nonionic surfactants are C9–C11 primary, straight-chain alcohols condensed with 5–9 moles of ethylene oxide, C12–C15 primary straight chain alcohols condensed with from 6–12 moles of ethylene oxide, or with 7–9 moles of a mixture of ethylene oxide and propylene oxide, C11–C15 secondary alcohols condensed with from 3–15 moles of ethylene oxide, and C10–C18 fatty acid diethanolamides, and tertiary amine oxides such as higher alkyl di(lower alkyl or lower substituted alkyl)amine oxides. Other useful nonionic surfactants include certain alkoxylated linear aliphatic alcohol surfactants which are believed to be the condensation products of a C8–C10 hydrophilic moiety with alkylene oxides, especially polyethylene oxide and or polypropylene oxide moieties. Such alkoxylated linear alcohol surfactants are presently commercially available under the tradename PolyTergent® (BASF, Mt. Olive, N.J.). Such nonionic surfactants are known to the art, and are more particularly described in McCutcheon's Detergents and Emulsifiers.

Further optional, but desirable constituents, include fragrances. Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

In compositions which include a fragrance, it is frequently desirable to include a fragrance solubilizer which assists in the dispersion, solution or mixing of the fragrance constituent in an aqueous base. These include known art compounds, including condensates of 2 to 30 moles of ethylene oxide with sorbitan mono- and tri-C10–C20 alkanoic acid esters having a HLB of 8 to are also known as nonionic surfactants. Further examples of such suitable surfactants include water soluble nonionic surfactants of which many are commercially known and by way of non-limiting example include the primary aliphatic alcohol ethoxylates, secondary aliphatic alcohol ethoxylates, alkylphenol ethoxylates and ethylene-oxide-propylene oxide condensates on primary alkanols, and condensates of ethylene oxide with sorbitan fatty acid esters. This fragrance solubilizer component is added in minor amounts, particularly amount which are found effective in aiding in the solubilization of the fragrance component, but not in any significantly greater proportion, such that it would be considered as a detergent constituent. Such minor amounts recited herein are generally up to about 0.5% by weight of the total composition but is more generally an amount of about 0.1% by weight and less, and preferably is present in amounts of about 0.05% by weight and less.

Further optional, but advantageously included constituents are one or more coloring agents which find use in modifying the appearance of the compositions and enhance their appearance from the perspective of a consumer or other end user. Known coloring agents, may be incorporated in the compositions in any effective amount to improve or impart to compositions a desired appearance or color. Such a coloring agent or coloring agents may be added in a conventional fashion, i.e., admixing to a composition or blending with other constituents used to form a composition.

The use of one or more pH adjusting agents, including minor amounts of mineral acids, basic compositions, and organic acids may be used. An exemplary composition includes citric acid, such as is available in an anhydrous salt form of an alkali metal citric acid. The addition of an effective amount such a pH adjusting agent is useful in establishing a targeted pH range for compositions according to the invention. The addition of an effective amount of a pH buffering composition so to maintain the pH of the inventive compositions may also be added. While the composition of the invention generally does not require a pH buffering composition, the use of such a pH buffering composition may provide the benefit of hard water ion sequestration.

Examples of such useful pH buffer compounds and/or pH buffering systems or compositions the alkali metal phosphates, polyphospates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, citrates, and their alkali metal salts. Such buffers keep the pH ranges of the compositions of the present invention within acceptable limits. Others, not particularly elucidated here may also be used. Preferably, citric acid, such as is available in an anhydrous salt form of an alkali metal citric acid is added as it is readily commercially available, and effective. The addition of such a buffering agent is desirable in certain cases wherein long term, i.e., prolonged storage, is to be anticipated for a composition, as well as insuring the safe handling of said aqueous composition.

Preservatives may also be added in minor amounts in the formulations according to the invention which preservative compositions do not include a disinfectant component. Known art compositions may be used. Examples of such preservatives compounds include those which are presently commercially available under the tradenames KathonX CG/ICP (Rohm & Haas, Philadelphia Pa.), SuttocideX A (Sutton Labs, Chatham N.J.) as well as MidtectX TFP (Tri-K Co., Emerson, N.J.). Such preservatives are generally added in only minor amounts, i.e., amounts of about 0.5% by weight of the total composition, more generally an amount of about 0.1% by weight and less, and preferably is present in amounts of about 0.05% by weight and less.

Another optional ingredient is an opacifying agent such as, for example, titanium dioxide.

The benefits of the compositions described in this specification include particularly: good removal of hard water stains, good removal of soap scum stains, relatively low toxicity, as well as ease in handling of the composition due to its readily pourable or pumpable characteristic, and when needed, disinfection. Further, when one or more of the optional constituents is added, i.e., fragrance and/or coloring agents, the esthetic and consumer appeal of the product is favorably improved.

The compositions according to the invention are useful in the cleaning and/or disinfecting of hard surfaces, having deposited soil thereon. In such a process, cleaning and disinfecting of such surfaces comprises the step of applying a stain releasing and disinfecting effective amount of a composition as taught herein to such a stained surface. Afterwards, the compositions are optionally but desirably wiped, scrubbed or otherwise physically contacted with the hard surface, and further optionally, may be subsequently rinsed from the surface.

The hard surface cleaner composition provided according to the invention can be desirably provided as a ready to use product in a pourable or manually squeezed bottle (deformable bottle). Examples of such squeezed bottles include U.S. Design Pat. Nos. D406,530, D406,531, D410,847, and D383,678 In such an application, the consumer generally applies an effective amount of the cleaning composition and within a few moments thereafter, wipes off the treated area with a rag, towel, brush or sponge, usually a disposable paper towel or sponge. In certain applications, however, especially where undesirable stain deposits are heavy, the cleaning composition according to the invention may be left on the stained area until it has effectively loosened the stain deposits after which it may then be wiped off, rinsed off, or otherwise removed. For particularly heavy deposits of such undesired stains, multiple applications may also be used.

The following examples below illustrate exemplary formulations and preferred formulations of the inventive composition. It is to be understood that these examples are presented by means of illustration only and that further useful formulations fall within the scope of this invention and the claims may be readily produced by one skilled in the art and not deviate from the scope and spirit of the invention. Throughout this specification and in the accompanying claims, weight percents of any constituent are to be understood as the weight percent of the active portion of the referenced constituent, unless otherwise indicated.

EXAMPLE FORMULATIONS

Preparation of Example Formulations:

Exemplary formulations illustrating certain preferred embodiments of the inventive compositions and described in more detail in Table I below were formulated generally in accordance with the following protocol.

Into a suitably sized vessel, a measured amount of water was provided after which the constituents were added in the following sequence: thickening agents, surfactant, acid and then the remaining constituents. Mixing, which generally lasted from 5 minutes to 120 minutes was maintained until the particular formulation appeared to be homogeneous. The exemplary compositions were readily pourable, and retained well mixed characteristics (i.e., stable mixtures) upon standing for extended periods, even in excess of 120 days. The constituents may be added in any order.

Examples of inventive formulations are shown in Table 1 below.

TABLE 1

| | Ex. 1 % w/w | Ex. 2 % w/w | Ex. 3 % w/w | Ex. 4 % w/w | Ex. 5 % w/w | Ex. 6 % w/w |
|---|---|---|---|---|---|---|
| citric acid[1] | 2.00 | 4.00 | 1.00 | 3.00 | 2.00 | 2.00 |
| formic acid[2] (94%) | 2.13 | — | 3.19 | 1.06 | 2.13 | 2.13 |
| Millisil W12[3] | 20.00 | 20.00 | 20.00 | 20.00 | 10.00 | 30.00 |
| Kronos 1000[4] | 1.00 | 1.00 | 1.00 | 1.00 | 1.00 | 1.00 |
| Mineral Colloid MO[5] | 2.50 | 2.50 | 2.50 | 2.50 | 2.50 | 2.50 |
| Xanthan Gum FN[6] | 0.40 | 0.40 | 0.40 | 0.40 | 0.40 | 0.40 |
| Rosulfan L33[7] (33%) | 3.00 | 3.00 | 3.00 | 3.00 | 3.00 | 3.00 |
| fragrance[8] | 0.20 | 0.20 | 0.20 | 0.20 | 0.20 | 0.20 |
| di water[9] | 68.77 | 68.90 | 68.71 | 68.84 | 78.77 | 58.77 |

[1]citric acid, anhydrous
[2]formic acid (94% conc. aqueous composition)
[3]microcrystalline silica, anhydrous
[4]titanium dioxide
[5]bentonite clay
[6]xanthan gum
[7]sodium lauryl sulfate (33% wt. actives)
[8]fragrance (proprietary composition)
[9]deionized water Efficacy on greasy soil cleaning, rust stain removal, lime scale/hard water removal, and soap scum removal of a composition of the present invention (Example 1) was evaluated against three commercially available products (CIF (ex. Unilever), MR. PROPER (ex. Procter & Gamble) and AJAX Bathroom Anti-Bacterial Cleaner (ex. Colgate-Palmolive). It is to be noted that the compositions according to the present invention, as well as CIF are thickened viscous cream-type cleaning compositions, while MR. PROPER and AJAX Bathroom Anti-Bacterial Cleaner are non-thickened compositions having a water-like viscosity. Nonetheless each of these compositions are used to treat the same types of stains and soils, rendering this comparison valid.

Greasy Soil Removal:

Cleaning efficacy of substrates bearing a greasy soil was conducted utilizing the Greasy Soil/Painted Masonite Wallboard Test Method of ASTM D 4488.

The methodology for cleaning efficacy of these products measured the effectiveness of the cream cleanser to remove soil from a painted surface. Masonite wallboard tiles (4.5"× 4.5") were painted with a flat white paint and then treated with an oil mixture using black carbon as a darkening agent. The soiled masonite tiles were then "cleaned" on the Gardner Abrasion Tester for 5 cycles. Ten grams of the cleanser was applied directly to the sponge each time for cleaning evaluation. Each half of the tile was "cleaned" with a different sample, resulting in two tests per tile. Subsequently measurements were taken using a Minolta Reflectometer CT-231. Three reflectance readings were taken per tile and the mean of these readings was used to calculate the % Cleaning Efficiency of the product.

$$\%\ \text{Cleaning Efficiency} = \frac{R_1 - R_2}{R_3 - R_2}$$

Where $R_1$=reflectance of soiled tile after cleaning $R_2$=reflectance of soiled tile before cleaning $R_3$=reflectance of tile before soiling

TABLE 2

| | Ex. 1 | CIF |
|---|---|---|
| % cleaning efficacy | 76.42 | 79.99 |

The foregoing results of Table 2 indicate good cleaning efficacy compared to the commercial CIF product.

Rust Stain Removal:

All four products were studied for their efficacy in the removal of rust stains. The methodology for cleaning efficacy measured the effectiveness of these products to remove rust stains from white ceramic tiles. Tiles were cleaned then treated with a rust stain blend which consisted of a 2.0% Ferric Chloride Solution which was sprayed, heat-treated and fixed on the tiles with a 1.0% Sodium Hydroxide Solution. The stained ceramic tiles were next cleaned on the Gardner Abrasion Tester for ten cycles. Ten grams of test sample was applied directly to the sponges each time for the cleaning evaluation. Sixteen tiles were used, one sample per tile.

Percent cleaning efficacy was evaluated using panel visual assessments. Thirty employee panelists were recruited and instructed to rate the tiles for the percent rust stain removal they observed. A 100-point scale was used where 0 represents no stain removal (very dirty tile) and 100 represents a 100% stain removal (very clean tile). Appropriate visual anchors were provided for the panelists as references (0%, 50% and 100% cleaned).

The 100-point scale results based upon visual assessments by panelists is indicated on Table 3.

TABLE 3

| Ex. 1 | CIF | MR. PROPER | AJAX |
|---|---|---|---|
| 30.2 | 13.4 | 2.3 | 3.0 |

The foregoing results of Table 3 indicate superior cleaning efficacy of a composition according to the invention as compared to the commercially available products.

Limescale Removal:

All four products were studied with respect to their efficacy in removing limescale.

The methodology for cleaning efficacy measured the effectiveness of these products to remove lime scale/hard water stains from black ceramic tiles. Tiles were cleaned, dried overnight, then treated with a hard water/limescale process specifically designed for this study. The hard water solution consisted of 2× concentration of $CaCl_2.2H_2O$ & $MgCl_2.6H_2O$ mixture which was sprayed along with a 2× concentration of $Na_2CO_3$ to create a precipitate on the tiles. The tiles were then heat-treated with a hot air gun set on high. The process was repeated three times to produce an even and substantial layer of limescale. The stained ceramic tiles were next cleaned on a Gardner Abrasion Tester for one cycle. Ten grams of test sample was applied directly to the sponges each time for the cleaning evaluation. Twenty-four tiles were used. Each half of the tile was cleaned with a different sample, resulting in two tests per tile.

Measurements were taken using a Gardner Micro Tri Gloss set at 60°. Eight reflectance readings were taken per tile half and the mean of these readings was used to calculate the % Cleaning Efficiency of the product for that half. Percent Cleaning Efficiency was calculated according to the following protocol:

$$\%\ \text{Cleaning Efficiency} = \frac{R_1 - R_2}{R_3 - R_2}$$

Where $R_1$=reflectance of soiled tile after cleaning $R_2$=reflectance of soiled tile before cleaning $R_3$=reflectance of tile before soiling The results reporting % cleaning efficacy is indicated on Table 4, following.

TABLE 4

| Ex. 1 | CIF | MR. PROPER | AJAX |
|---|---|---|---|
| 98.1 | 43.1 | 70.2 | 52.2 |

The foregoing results of Table 4 indicate superior cleaning efficacy of a composition according to the invention as compared to the commercially available products.

Soapscum Removal:

All four products were studied with respect to their efficacy in removing soapscum.

The methodology for cleaning efficacy measured the effectiveness of the products to remove lime soap soil deposits from black ceramic tiles. Tiles were cleaned, dried overnight, then treated with a lime soap soil process specifically designed for this protocol. The soap scum soil is a multi-component soil consisting of residues of body soils, soil remnants and residue of various cleaners. After soil application, the tiles were heat-treated in a 205 C. degree oven to make the soil more tenacious. The stained ceramic tiles were next cleaned on the Gardner Abrasion Tester for ten cycles. Ten grams of test sample was applied directly to the sponge (1¾×3⅝×1" size) each time for the cleaning evaluation. The sponge was inverted onto the tiles and the scrubbing process was immediately initiated without a wait time. Sixteen tiles were used, one sample per tile. Measurements were taken using the Gardner Micro Tri Gloss set at 60°. Eight reflectance readings were taken per tile and the mean of these readings was used to calculate the % Cleaning Efficiency. Percent Cleaning Efficiency was calculated according to the following protocol:

$$\%\ \text{Cleaning Efficiency} = \frac{R_1 - R_2}{R_3 - R_2}$$

Where $R_1$=reflectance of soiled tile after cleaning $R_2$=reflectance of soiled tile before cleaning $R_3$=reflectance of tile before soiling The results reporting % cleaning efficacy is indicated on Table 5, following.

TABLE 5

| Ex. 1 | CIF | MR. PROPER | AJAX |
|---|---|---|---|
| 83.9 | 85.8 | 95.6 | 76.4 |

The foregoing results of Table 5 indicate good cleaning efficacy of a composition according to the invention, namely Example 1, as compared to several commercially available products.

The invention claimed is:

1. A process for removing rust stains from a hard surface comprising the steps of:

providing an aqueous acidic hard surface cleaning composition which comprises:

an acidic constituent which is a mixture of citric acid and formic acid;

0.001–10% by weight of at least one anionic surfactant;

0.001–10% by weight of a thickener selected from the group consisting of cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, succinoglycan, xanthan gum, guar gum, locust bean gum, tragacanth gum or derivatives thereof, clays selected from the group consisting of kaolinite, dicktite, hectorite, bentonite, nacrite, halloysite, endillite, chrysotile, amesite, beidellite, nontronitc, saponite, sauconite, illites; glauconite, chlorite, vermiculite, attapulgite, sepiolite, allophane, and imogolite, and silicas selected from the group consisting of diatomite, precipitated silica and fumed silica, and mixtures thereof;

10–30% by weight of a scrubbing agent selected from the group consisting of quartzes, siliceous chalk, diatomaceous earth, colloidal silicon dioxide, alkali metasilicates, organic abrasive materials selected from the group consisting of polyolefins, polyethylenes, polypropylenes, polyesters, polystyrenes, acetonitrile-butadiene-styrene resins, melamines, polycarbonates, phenolic resins, epoxies and polyurethanes and mixtures thereof;

0–10% by weight of one or more optional constituents; and the balance to 100% by weight, water wherein the pH of the composition is less than 6.

2. The process according to claim 1 wherein the thickener constituent of said aqueous acidic hard surface cleaning composition is a mixture of clay and xanthan gum.

3. The process according to claim 2 wherein the clay of said aqueous acidic hard surface cleaning composition is bentonite clay.

4. The process according to claim 2 wherein the said aqueous acidic hard surface cleaning composition includes an optional constituent selected from the group consisting of: nonionic surfactants, coloring agents, fragrances, fragrance adjuvants and/or fragrance solubilizers, pH adjusting agents, pH buffers, antioxidants, water softening agents, opacifying agents, and preservative compositions.

5. The process according to claim 1 wherein the said aqueous acidic hard surface cleaning composition has a pH from about 5.0 to about 1.0.

6. The process according to claim 5 wherein the pH of said aqueous acidic hard surface cleaning composition is from about 4.0 to about 1.0.

7. The process according to claim 6 wherein the pH of said aqueous acidic hard surface cleaning composition is from about 3.0 to about 1.0.

8. The process according to claim 1 wherein the thickener constituent of said aqueous acidic hard surface cleaning composition is a mixture of hydroxy alkyl celluloses, and xanthan gum.

9. The process according to claim 8 wherein the hydroxyl alkyl cellulose of said aqueous acidic hard surface cleaning composition is hydroxy ethyl cellulose.

10. The process according to claim 1 wherein said aqueous acidic hard surface cleaning and disinfecting composition exhibits a viscosity of from about 100 to about 2000 centipoise measured by a Brookfield RVT viscometer, spindle #2, at 60 rpm at room temperature.

11. A rust removing hard surface cleaning composition which comprises:

an acidic constituent which is a mixture of citric acid and formic acid;

0.001–10% by weight of at least one anionic surfactant;

0.001–10% by weight of a thickener selected from the group consisting of cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, succinoglycan, xanthan gum, guar gum, locust bean gum, tragacanth gum or derivatives thereof, clays selected from the group consisting of kaolinite, dicktite, hectorite, bentonite, nacrite, halloysite, endillite, chrysotile, amesite, beidellite, nontronite, saponite, sauconite, illites; glauconite, chlorite, vermiculite, attapulgite, sepiolite, allophanc, and imogolite, and silicas selected from diatomite, precipitated silica and fumed silica, and mixtures thereof;

10–30% by weight of a scrubbing agent selected from quartzes, siliceous chalk, diatomaceous earth, colloidal silicon dioxide, alkali metasilicates, organic abrasive materials selected from polyolefins, polyethylenes, polypropylenes, polyesters, polystyrenes, acetonitrile-butadiene-styrene resins, melamines, polycarbonates, phenolic resins, epoxies and polyurethanes and mixtures thereof;

0–10% by weight of one or more optional constituents; and the balance to 100% by weight, water wherein the pH of the composition is less than 6.

12. The composition according to claim 11 wherein the thickener constituent of said aqueous acidic hard surface cleaning composition is a mixture of clay and xanthan gum.

13. The composition according to claim 11 wherein the clay of said aqueous acidic hard surface cleaning composition is bentonite clay.

14. The composition according to claim 2 wherein the said aqueous acidic hard surface cleaning composition includes an optional constituent selected from the group consisting of: nonionic surfactants, coloring agents, fragrances, fragrance adjuvants and/or fragrance solubilizers, pH adjusting agents, pH buffers, antioxidants, water softening agents, opacifying agents, and preservative compositions.

15. The composition according to claim 11 wherein the said aqueous acidic hard surface cleaning composition has a pH from about 5.0 to about 1.0.

16. The composition according to claim 15 wherein the pH of said aqueous acidic hard surface cleaning composition is from about 4.0 to about 1.0.

17. The composition according to claim 16 wherein the pH of said aqueous acidic hard surface cleaning composition is from about 3.0 to about 1.0.

18. The composition according to claim 11 wherein the thickener constituent of said aqueous acidic hard surface cleaning composition is a mixture of hydroxy alkyl celluloses, and xanthan gum.

19. The composition according to claim 18 wherein the hydroxyl alkyl cellulose of said aqueous acidic hard surface cleaning composition is hydroxy ethyl cellulose.

20. The composition according to claim 11 wherein said aqueous acidic hard surface cleaning and disinfecting composition exhibits a viscosity of from about 100 to about 2000 centipoise measured by a Brookfield RVT viscometer, spindle #2, at 60 rpm at room temperature.

* * * * *